United States Patent [19]

Schindel

[11] Patent Number: 4,537,230

[45] Date of Patent: Aug. 27, 1985

[54] APPARATUS FOR MOVING DISPENSING PISTONS AND FILLING TUBES

[75] Inventor: Hugo Schindel, Saulheim, Fed. Rep. of Germany

[73] Assignee: Rationator-Maschinenbau GmbH, Hillesheim, Fed. Rep. of Germany

[21] Appl. No.: 519,676

[22] Filed: Aug. 2, 1983

[30] Foreign Application Priority Data

Aug. 3, 1982 [DE] Fed. Rep. of Germany ..... 3228935

[51] Int. Cl.[3] ..... B65B 3/12; B67D 5/46

[52] U.S. Cl. ..... 141/146; 141/259; 141/279; 141/284; 74/89.15

[58] Field of Search ..... 141/128, 250–284, 141/129–191, 94–96, 192–229; 74/89.15

[56] References Cited

U.S. PATENT DOCUMENTS 4,065,032 12/1977 Lydiksen ..... 74/89.15

*Primary Examiner*—Houston S. Bell, Jr.

*Attorney, Agent, or Firm*—Kinzer, Plyer, Dorn & McEachran

[57] ABSTRACT

The subject of the invention is an apparatus for moving dispensing pistons (5) and filling tubes (18) in the charging of containers, it being necessary on the one hand during the dispensing and depending on the filling product, to vary the rate and on the other hand to suit the travel rate of the filling tube to the rising filling level. This is achieved substantially by the fact that the dispensing piston (5) and the filling tube (18) are operated in each case with the assistance of screwed spindles (7 and 11), the drive being provided through infinitely variable electric motors (10, 12). Programmes can very readily be set for the individual movements, the drive being controlled for this purpose and the spindles (7, 11) being particularly suitable for the transmission of the movement.

4 Claims, 4 Drawing Figures

APPARATUS FOR MOVING DISPENSING PISTONS AND FILLING TUBES

BACKGROUND OF THE INVENTION

This invention relates to an apparatus for moving dispensing pistons and filling tubes during the filling of containers, particularly shaped bottles, and in which the movement is programmed.

During a dispensing it is necessary, depending on the filling product, to vary the speed in the intake and also in the output region. There are a series of products which are sensitive to intake and output. In this case a slower action is necessary during input at the beginning, this is then accelerated and may later be slowed down. Even in the case of pumping into a special shape of container and method used can be similar.

During the travel of the filling tube it is also important for the travel speed to keep pace with the rising filling level. Distinction is made here between an under- or an over-filling level, and certainly thus depends on the type of filling material, for example viscous or thin-flowing or foaming material. In the case of shaped bottles account has to be taken of the fact that in the waist area of a container the filling level is reached quicker and in the belly region slower. These movements are completely different from container to container.

Known are apparatus of the type in which the operation of the pistons is performed by means of eccentrics, bell crank levers or through cam plates pneumatically or hydraulically. The same control means is provided for the filling tube. During the treatment of bottles of differing shape there is a manual changeover of equipment and also an eventual exchange of parts or cam discs, skilled practitioners being required for these activities and also a large amount of time required. The pauses in operation which this involves are very unfavourable for such apparatus because they involve a loss of production.

BRIEF DESCRIPTION OF THE INVENTION

The object of the invention is to devise an apparatus of the kind set forth above which caters for the filling of containers which differ in height, diameter and shape either with an under- or over level filling, this with the simplest means.

This object is met in the present invention by the fact that the dispensing pistons and the filling tube in each case are movable and that the spindles are operable with the assistance of a programmed electronic computer.

An advantageous embodiment resides in the fact that the drive is provided by infinitely variable electric motors.

It is advantageous for a number of dispensing pistons and filling tubes to be arranged on a dispensing yoke or a filling head.

Finally it is proposed that the motors shall be arranged on a machine table which drive spindle nuts or the spindles through reduction gearing. The invention has the advantage that both the speed during both strokes of the pumping action and also the lifting of the filling tube for each bottle shape can be pre-set in simple fashion by the fact that the corresponding and preselected programme is called from the data processing equipment. A control of this nature can be performed quite simply because of the use of a screwed spindle drive. A programme and movement sequence for each volume of filling and type of container can be stored in electronic computers.

BRIEF DESCRIPTION OF THE DRAWINGS

The invention will now be described with reference to an example of embodiment illustrated in the accompanying drawings. In these drawings.

DETAILED DESCRIPTION OF THE DRAWINGS

Figure 1:
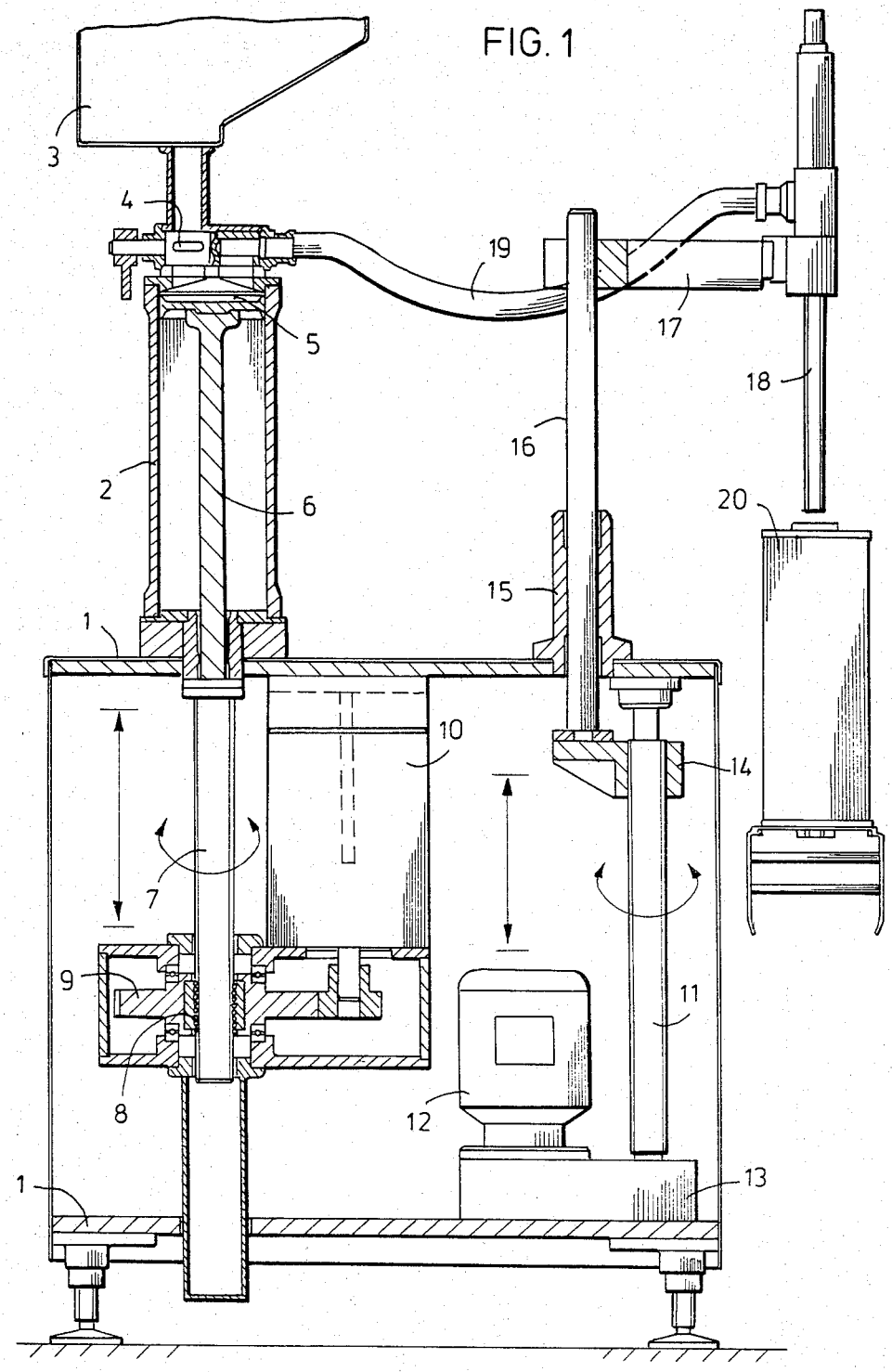
FIG. 1 is a section through a first embodiment of an operating apparatus of this kind.

The apparatus illustrated in FIG. 1 comprises a machine frame 1 with a dispensing cylinder 2 mounted on it. Disposed on this dispensing cylinder 2 is a supply container 3, a valve 4 being arranged between them. The up and down reciprocal movement of the piston 5 disposed in the cylinder 2, with its piston rod 6, is performed through a screwed spindle 7 which is flanged on the piston rod 6, this spindle 7 being guided in a spindle nut 8. The spindle nut 8 is secured in the toothed wheel 9 of a reduction gearing flanged to an infinitely variable electric motor 10, whereby the spindle nut 8 assumes a fixed position and the spindle 7 and with it the piston 6 performs the up and down movement. Arranged on the frame 1 is a spindle 11 which is operated through a further infinitely variable electric motor 12 with reduction gearing 13, a spindle nut 14 being displaceably arranged thereon. The spindle nut 14 carries laterally a rod 16 disposed in a bush 15 which through a cross piece 17 carries a filling tube 18 connected to the container 3 through a hose 19. A container 20 is disposed beneath this filling tube 18.

By appropriate operation of the spindles 7, 11, the movements of the piston 6 and the filling tube 18 are appropriately regulated. Electronic computers are particularly suitable for this because a programme and pattern of movement can be stored therein for each filling volume and container shape.

Figure 2:
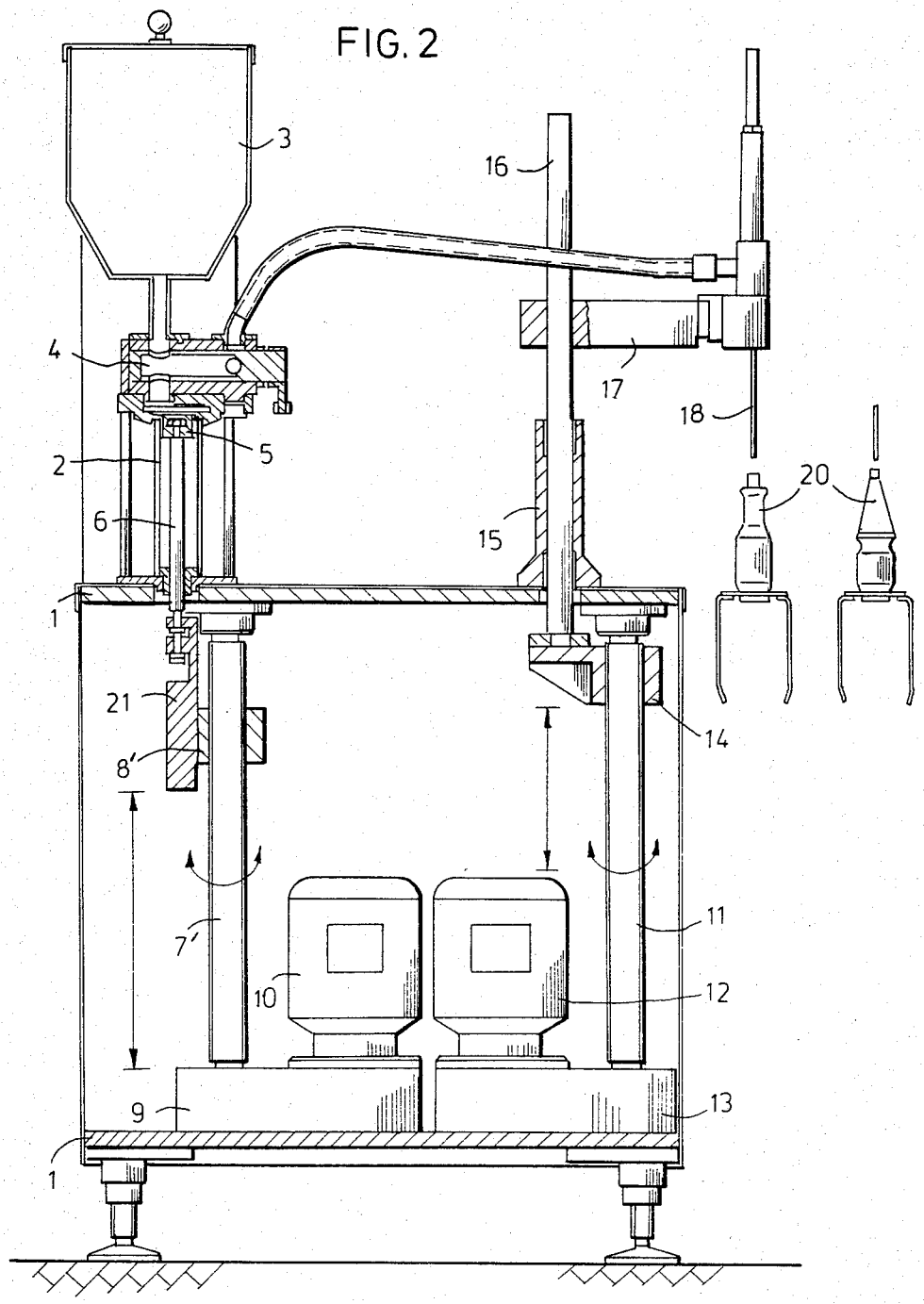
FIG. 2 shows a further embodiment of this apparatus in section.

The embodiment illustrated in FIG. 2 differs from that in FIG. 1 in that the spindle 7' is not heightwise displaceable, and has the nut 8' heightwise movable on the spindle 7', and carrying a bracket 21 with the piston 6 secured thereto. The spindle 7' is driven from the motor 10 and its reduction gearing 9. Arranged laterally to the filling tube 18 different containers are shown, particularly to demonstrate that the most complicated forms of container can be lifted in the required fashion with a minimum expenditure to technical resources.

Figure 3:
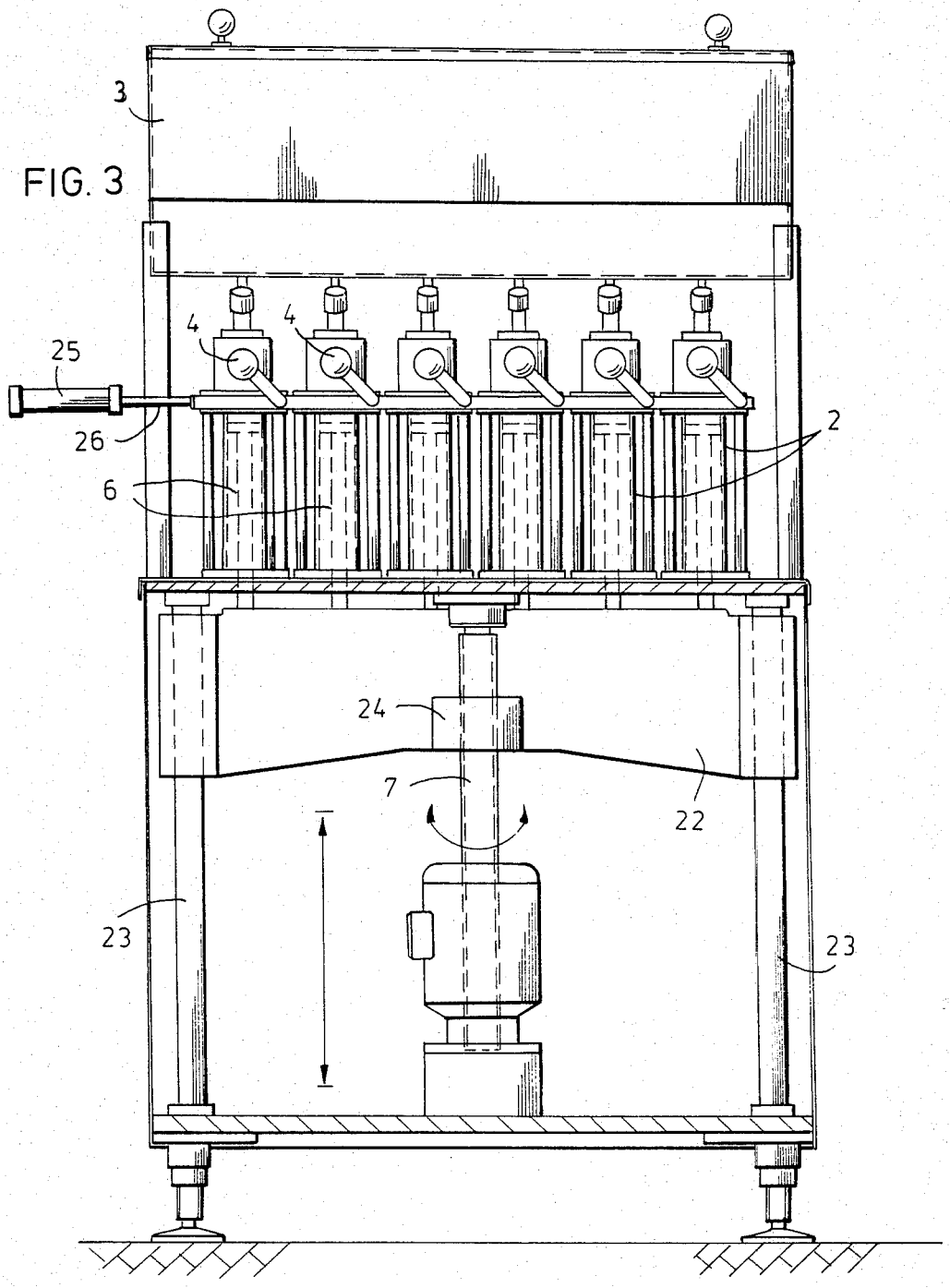
FIG. 3 shows the arrangement of the apparatus with simultaneous operation of a plurality of dispensing pistons.

In the arrangement illustrated in FIG. 3 a plurality of dispensing units 2, 6 are provided, the individual piston rods 6 of which are arranged on a common dispensing yoke 22. This yoke 22 is guided laterally on guide columns 23, the up and down movement being performed through the spindle 7 arranged centrally thereof. Disposed in the dispensing yoke 22 are an appropriate number of spindle nuts 24 for providing the up and down movement. A cylinder-piston aggregate 25 with a thrust rod 26 is used for operation in common with the valves 4.

Figure 4:
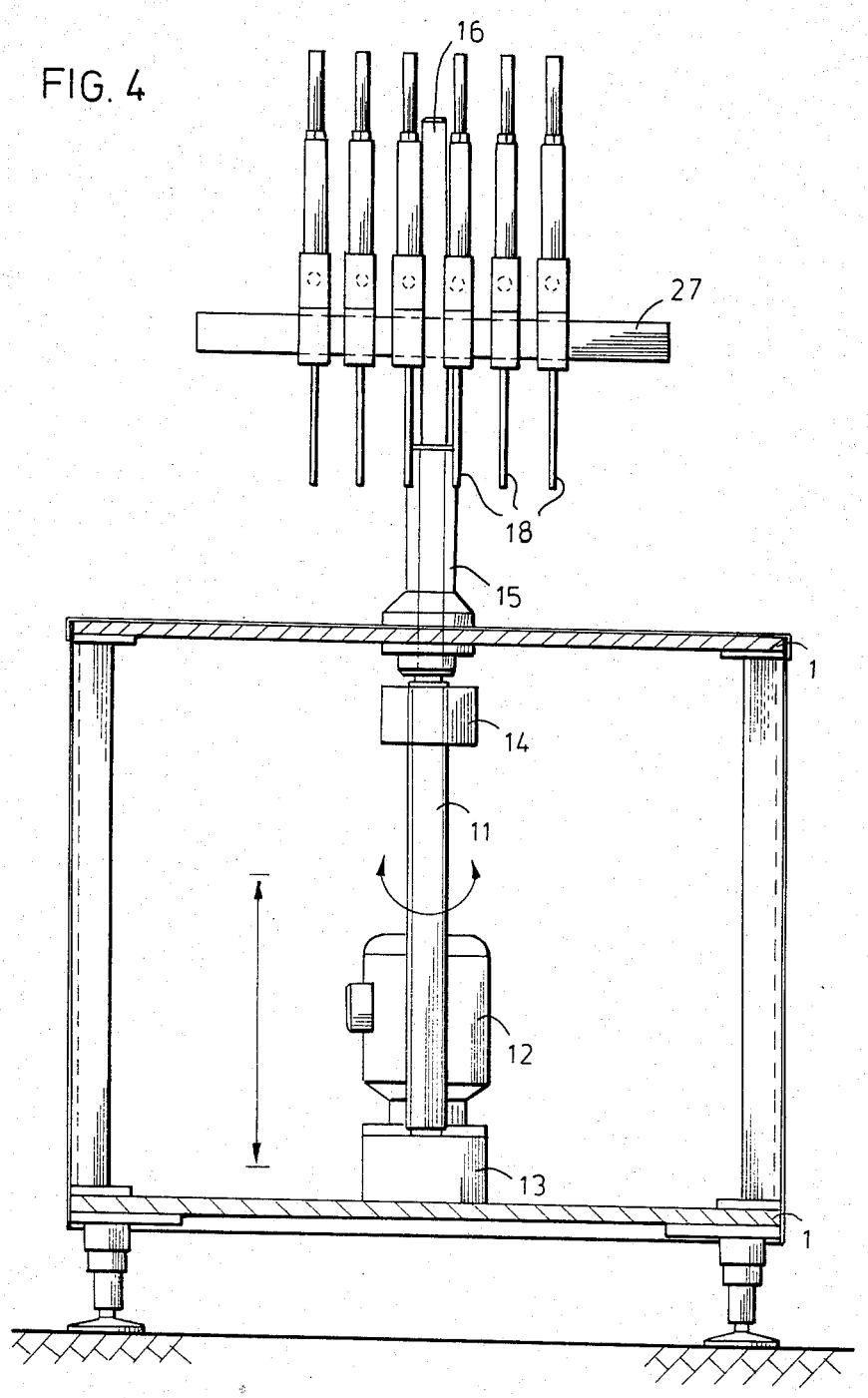
FIG. 4 shows an apparatus of this nature for operating a plurality of filling tubes.

Further FIG. 4 shows a common drive for a plurality of filling tubes 18 arranged on a common cross beam or yoke 27. This beam 27 is secured to a rod 16 connected to the spindle nut 14 running on the spindle 11. In combination with the automatic control through the electronic computer this caters for a problem-free movement of the total filling tube system, to operate this filling head through the usual means by weight requiring in particular circumstances a greater number of personnel.

I claim:

1. Apparatus for moving a dispensing piston and a filling tube during the filling of shaped containers with a fluid, comprising at least one dispensing piston and at least one filling tube spaced therefrom, separate first and second screw-threaded spindles and nuts mated thereto respectively to move the piston to dispense filling fluid to the filling tube and to position the filling tube relative to the container to be filled thereby, each spindle having a driven element for rotating the spindle, and respective drive means for each spindle including an infinitely variable electric motor gear-coupled to the related driven element.

2. Apparatus according to claim 1, wherein the spindle nuts are either fixed or displaceable.

3. Apparatus according to claim 1, wherein a dispensing yoke or filling head is provided on which are arranged a plurality of dispensing pistons and wherein the first screw-threaded spindle supports the yoke.

4. Apparatus according to claim 1 wherein a supporting yoke is provided on which are arranged a plurality of filling tubes and wherein the supporting yoke is actuated by the second screw-threaded spindle.

* * * * *